US005473297A

United States Patent [19]

Sako et al.

[11] Patent Number: 5,473,297

[45] Date of Patent: Dec. 5, 1995

[54] ELECTROMAGNETIC RELAY

[75] Inventors: Kazumi Sako, Osaka; Kiyoaki Kuzukawa, Kyoto, both of Japan

[73] Assignee: Omron Corporation, Najaokakyo, Japan

[21] Appl. No.: 200,453

[22] Filed: Feb. 23, 1994

[30] Foreign Application Priority Data

Feb. 24, 1993 [JP] Japan ..... 5-035239

[51] Int. Cl.[6] ..... H01H 51/22

[52] U.S. Cl. ..... 335/78; 335/80; 335/83

[58] Field of Search ..... 335/78–86, 128, 335/130–133, 202

[56] References Cited

U.S. PATENT DOCUMENTS 5,337,029 8/1994 Nobutoki et al. ..... 335/78

FOREIGN PATENT DOCUMENTS 0196022 10/1986 European Pat. Off. .
0293199 11/1988 European Pat. Off. .
0523855 1/1993 European Pat. Off. .

*Primary Examiner*—Lincoln Donovan
*Attorney, Agent, or Firm*—Fish & Richardson

[57] ABSTRACT

An electromagnetic relay having movable contactors which extend along either side of a movable armature. The movable armature and the movable contactors are formed integrally with the central support member by outsert molding. Movable contact terminals, which extend from the movable contactors, are molded to the base sections. Connecting pieces, which are located on the bases of the movable contact terminals, are bent to form a rotating shaft. The front ends of the base sections protrude toward each other to form the base. The movable contacts on the movable contactors are positioned so that they alternately contact and draw away from the fixed contacts on the base.

12 Claims, 9 Drawing Sheets

ELECTROMAGNETIC RELAY

FIELD OF THE INVENTION

This invention relates to an electromagnetic relay. More specifically, it concerns a miniature electromagnetic relay commonly known as a chip relay.

BACKGROUND OF THE INVENTION

An example of an existing miniature electromagnetic relay is shown in FIG. 19. This relay consists of a box-shaped base 2, an electromagnetic block 4, a movable block 6, and a box-shaped case 7. Base 2 has a number of terminals molded onto it: common terminal 1*a*, fixed contact terminals 1*b*, and coil terminals 1*c*. Permanent magnet 3*b* is held in place by U-shaped iron core 3*a*. Coil 3*d* is wound around molded bobbin 3*c*, and the ends of the coil are tied and welded to studs 3*f* on lug terminal strips 3*e*. The bobbin is then mounted onto the base. Electromagnetic block 4 is formed as an integral unit by welding the lug terminal strips 3*e* to connection points 1*d* on coil terminals 1*c* located on the bottom of box-shaped base 2. (The connection point on the front of the base is not shown.) Electromagnetic block 4 is joined with support member 5*c* which supports movable contactors 5*b* at their centers. The movable contactors are disposed lengthwise along either side of movable armature 5*a*. Movable block 6 is formed as an integral unit by welding connectors 5*d*, which are formed as extensions from the centers of movable contactors 5*b*, to connection points 1*e* on common terminal 1*a*. Box-shaped case 7 has dimensions such that it can engage with the box-shaped base 2. The electromagnetic relay described above has a number of disadvantages.

In the electromagnetic relay described above, connectors 5*d* on movable block 6 are welded to connection points 1*e*. The welding process is essential, and since working space must be provided in and around the welding points, it is difficult to reduce the size of the device.

If the relay is to be made smaller, the welding points must be made smaller, which makes the task of welding significantly more difficult, and reduces production efficiency.

Another disadvantage of the electromagnetic relay described above is that because impurities such as carbon are generated during the welding process, a defective contact may occur. Also, variations in the welding process may lead to aberrations in the operating characteristics.

Further, since the relay described above has four independent structural components, it requires a large number of components and a large number of assembly processes. This makes it more difficult to manage the production process, and has an adverse effect on the precision with which the components are assembled.

SUMMARY OF THE INVENTION

In light of the problems discussed above, the electromagnetic relay of this invention was designed to provide a relay which would not require a welding process in its assembly, and which would not use a large number of components.

In one aspect, this invention provides an electromagnetic relay in which contacts are made and broken by means of the movement of an armature supported by a rotating shaft. The movement of the armature results from the magnetization and demagnetization of an electromagnetic block.

In the relay of this invention, one end of the connecting piece which forms the rotating shaft is positioned on at least one side of the movable armature, while the other end is formed to be integral with the base; and the connecting piece is bent to support the movable armature pivotally on the base.

The movable armature and the movable contactors, which are positioned lengthwise along either side of the movable armature, are formed to be integral with their support member, which is molded. At least one of the movable contact terminals, which are the connecting pieces that extend from the movable contactors, is molded to the base. The connecting pieces, which are on the bases of the movable contact terminals, are bent to form a rotating shaft. Because the movable armature is supported by the base so that it is free to move, the movable contacts of the movable contactors can make and break contact with fixed contacts furnished on the base.

The movable armature and the movable contactors, which are positioned lengthwise along either side of the movable armature, are formed to be integral with their support member, which is molded. Base sections, which are roughly L-shaped when viewed in cross section, are molded onto each of the movable contact terminals, which are the connecting pieces that extend from the movable contactors. The connecting pieces, which are located on the bases of the movable contact terminals, are bent to form a rotating shaft. The front ends of the base sections protrude toward each other to form the base.

The movable armature and the movable contactors, which are positioned lengthwise along either side of the movable armature, are formed to be integral with their support member, which is molded. The movable connector terminals, which are the connecting pieces that extend from the movable contactors, are molded to the base. The connecting pieces, which are on the bases of the movable contact terminals, are bent to form a rotating shaft. The other movable shaft, which protrudes from the other side of the movable armature, may be held in position and pivotally supported by a case which fits onto the base.

Alternatively, the movable armature and the movable contactor, which are positioned lengthwise along one side of the movable armature, may be formed to be integral with their support member, which is molded. The movable contact terminals, which are the connecting pieces that extend from the movable contactor, may be molded to the base. The connecting piece, which is on the base of the movable contact terminal, may be bent to form a rotating shaft. The other end of the movable shaft, which protrudes from the other side of the movable armature, may engage with and be pivotally supported by the base.

This invention has the advantage that it eliminates the necessity of a welding process and reduces the number of components.

The electromagnetic relay of this invention has a movable armature which is integrally molded with a base through its connecting pieces. This design eliminates the need for a welding process. At the same time, it dispenses with the need for working space in and around the welding site which is required in previous relays. This allows the device to be further miniaturized, while preventing the significant drop in production efficiency which resulted from previous designs.

Since this design does not require a welding process, no carbon or other impurities are generated, and contact defects are unlikely to occur. The relay does not suffer from aberrations in its operating characteristics due to welding variation.

Another advantage of the electromagnetic relay of this invention is that the number of components is reduced. This, in turn, reduces the number of production steps, which makes production easier to manage and improves the precision with which the components can be assembled.

Additionally, since in one preferred embodiment, movable contactors and other components are formed from a single lead frame, the advantage that management of the production process is simplified is provided.

DESCRIPTION OF THE FIGURES

FIG. 6 is an oblique view of the base of the electromagnetic relay of FIG. 1 before the contact mechanisms have been molded on;

FIG. 7 is a plan view of the base of the electromagnetic relay of FIG. 1 before the contact mechanisms have been molded on;

FIG. 8 is a lateral view of the base of the electromagnetic relay of FIG. 1 before the contact mechanisms have been molded on;

FIG. 11 is a front view of the base of the electromagnetic relay of FIG. 1 before the contact mechanisms have been molded on;

FIG. 17 is an oblique view of the base of the electromagnetic relay of a second embodiment of this invention before the contact mechanisms have been molded on;

FIG. 18 is an oblique view of the base of the electromagnetic relay of FIG. 17 before the contact mechanisms have been molded on.

DETAILED DESCRIPTION OF THE INVENTION

We shall next explain some embodiments of this invention with reference to the appended drawings, FIGS. 1 through 18.

The first embodiment of an electromagnetic relay of this invention comprises a base 20, which has the mechanisms for making and breaking contact built into it (to be described in more detail below), and an electromagnetic case 40, as shown in FIGS. 1 through 16.

Figure 1:
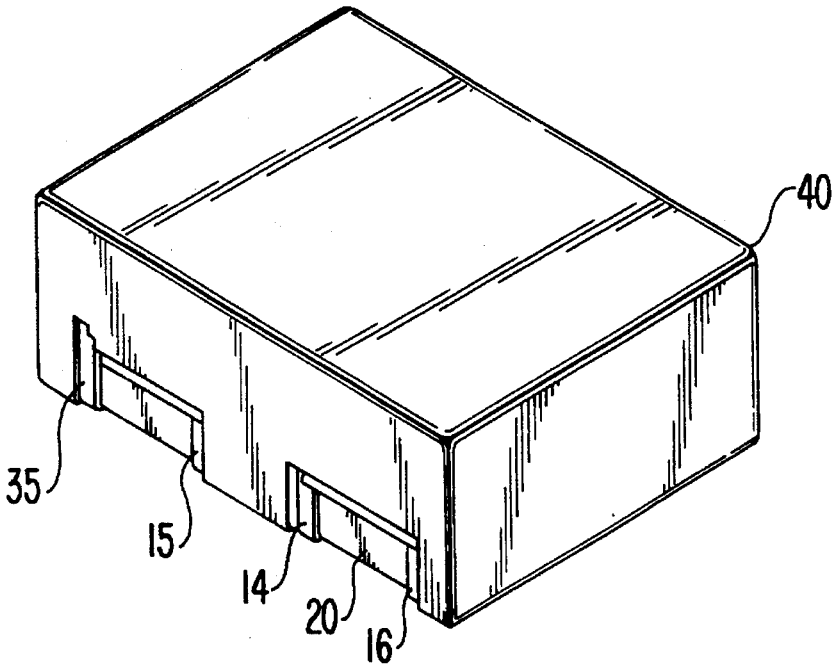
FIG. 1 is an oblique view of the electromagnetic relay of a first embodiment of this invention.
Figure 2:
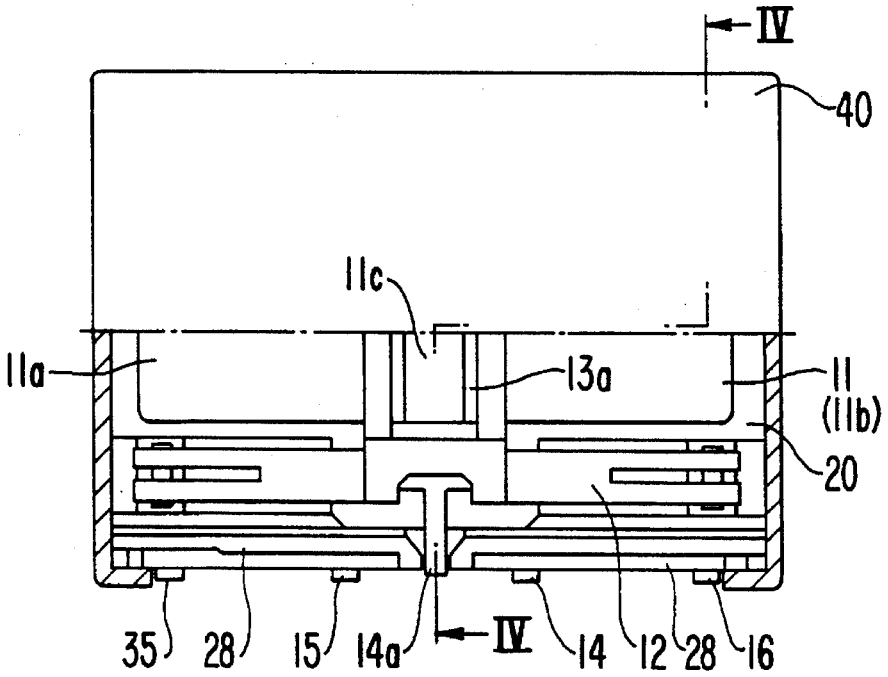
FIG. 2 is a cross-sectional view from the top face of the electromagnetic relay of FIG. 1.
Figure 3:
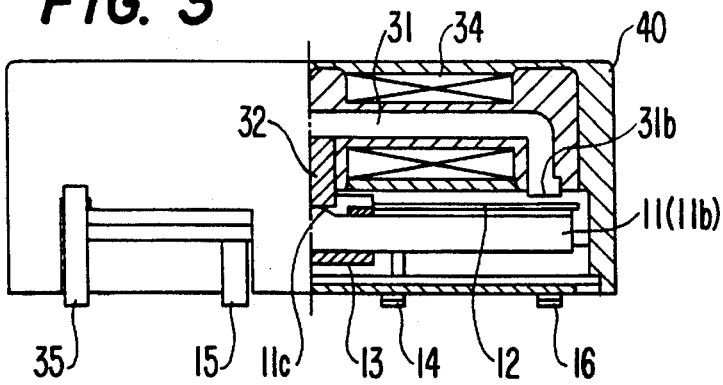
FIG. 3 is a cross sectional view from the front face of the electromagnetic relay of FIG. 1.
Figure 4:
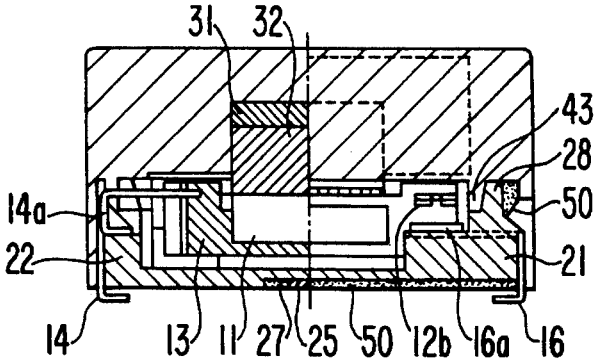
FIG. 4 is a cross-section taken along lines IV—IV shown in FIG. 2.
Figure 6:
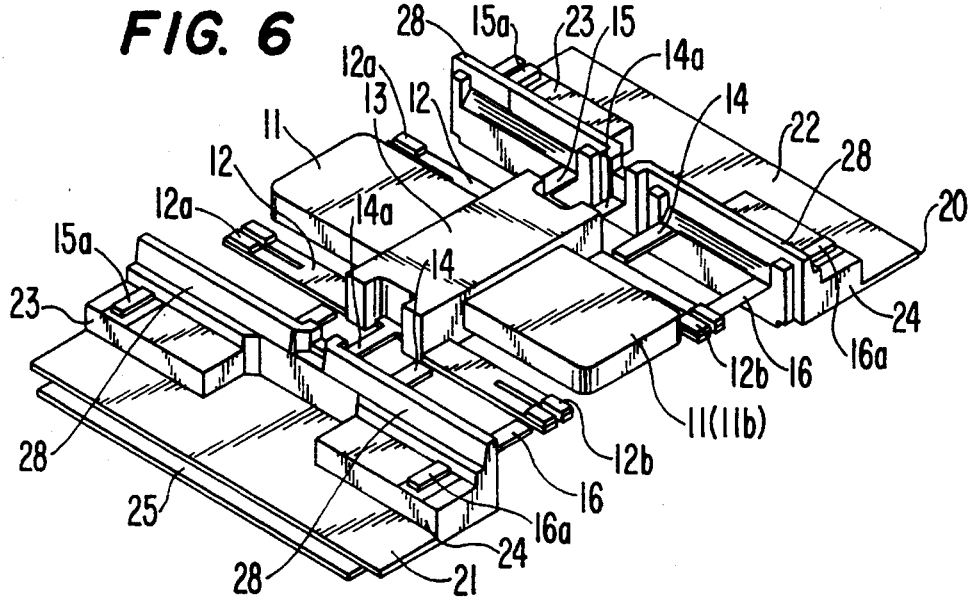

FIG. 1 provides an electromagnetic relay of this invention, according to a first embodiment, including case 40; base 20 having fixed contact terminals 15, 16, sidewalls 28, movable contact terminal 14 having connecting piece 14*a*, and coil terminal 35; and movable armature 11 having two ends 11*a*, 11*b*, columnar shaft 11*c*, movable contactors 12, and support member 13 (not shown) having opening 13*a*.

FIGS. 6 through 11 show in more detail the invention as depicted in FIGS. 1–5. As shown these FIGS., base 20 of an electromagnetic relay of the invention comprises movable armature 11; movable contactors 12, which are comprised of lead frames positioned lengthwise along either side of the armature; and roughly J-shaped movable contact terminals 14, which are formed to be integral with central support member 13 by outsert molding. Contact terminals 14 extend outward from the center of the movable contactors 12, and form the connecting pieces which protrude from the ends of the central support member 13. Armature 11, contactors 12, and terminals 14 are all molded onto base sections 21, 22. At either end of each of the movable contactors 12 are twin contacts 12*a*, 12*b*.

Figure 5:
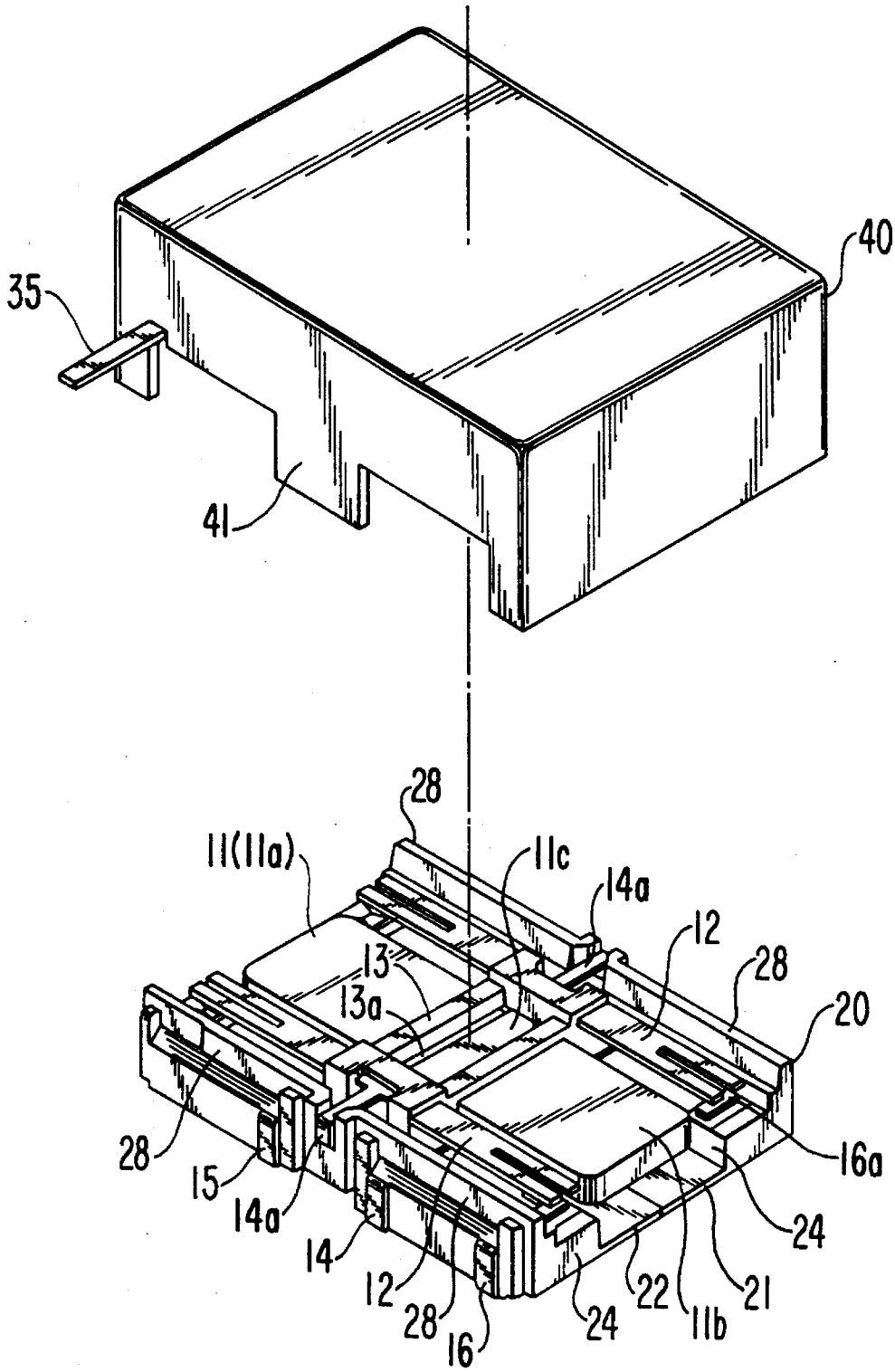
FIG. 5 is an exploded oblique view of the electromagnetic relay of FIG. 1.
Figure 7:
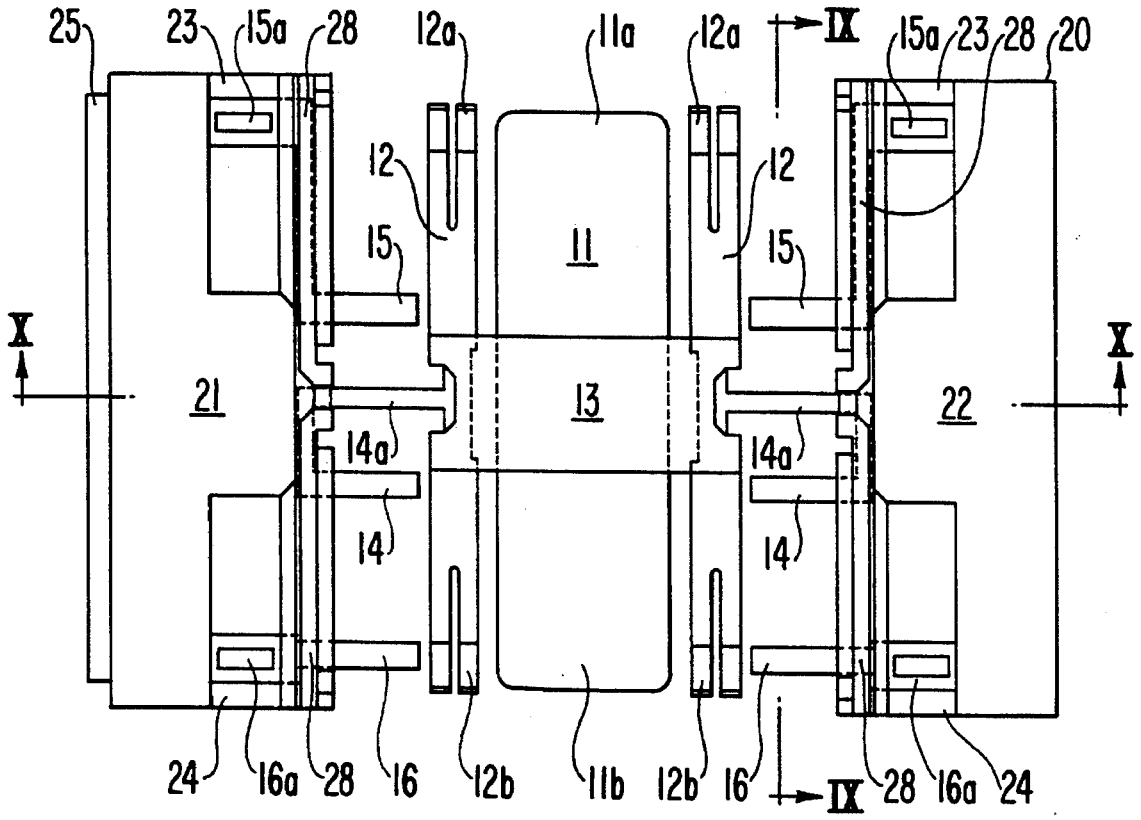
Figure 8:
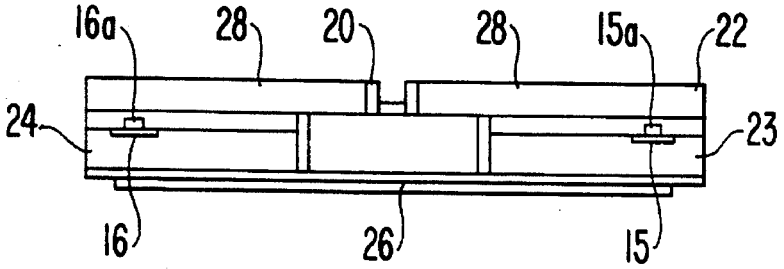
Figure 9:
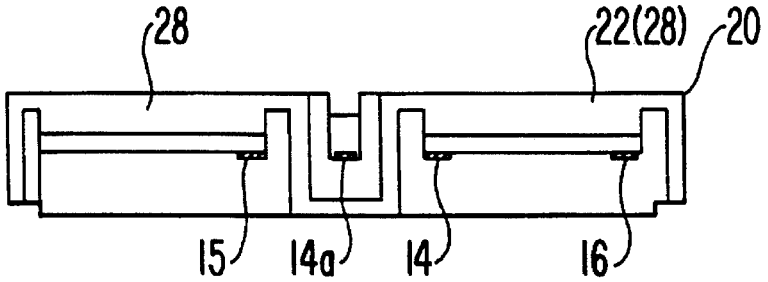
FIG. 9 is a cross-section taken along line IX—IX shown in FIG. 7.
Figure 10:
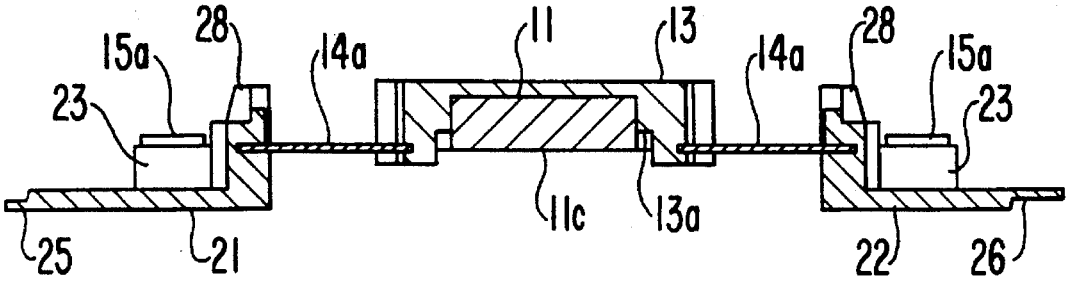
FIG. 10 is a cross-section taken along line X—X shown in FIG. 7.
Figure 11:
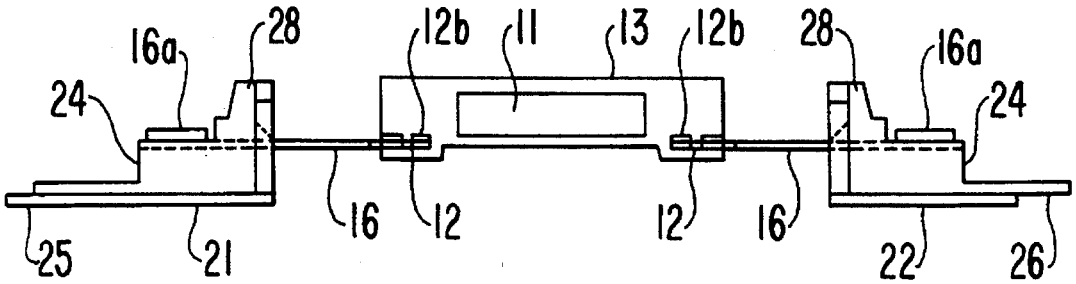
Figure 12:
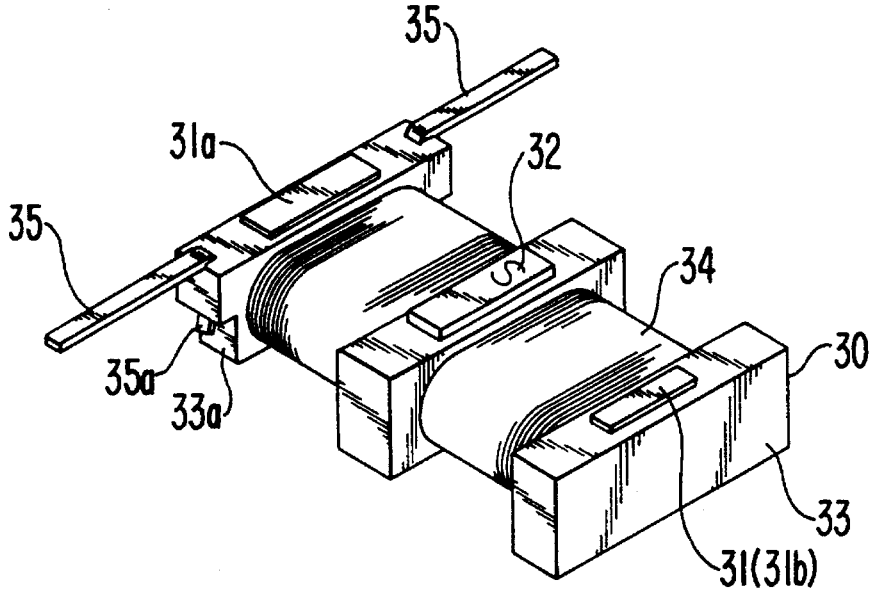
FIG. 12 is an oblique view of the electromagnetic block in the electromagnetic relay of FIG. 1.
Figure 13:
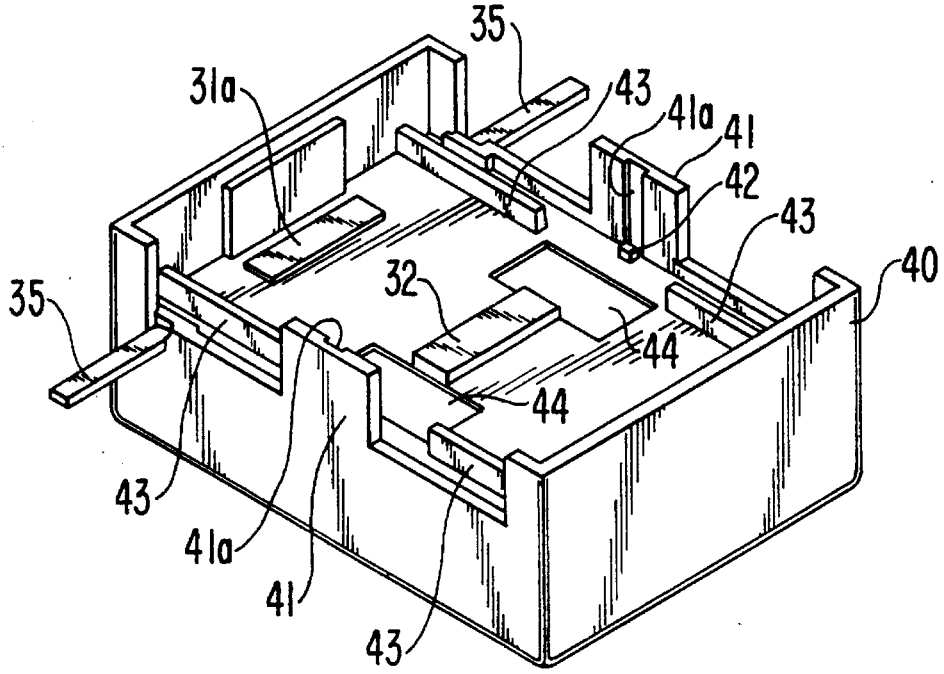
FIG. 13 is an oblique view of the electromagnetic case of the electromagnetic relay of FIG. 1.
Figure 14:
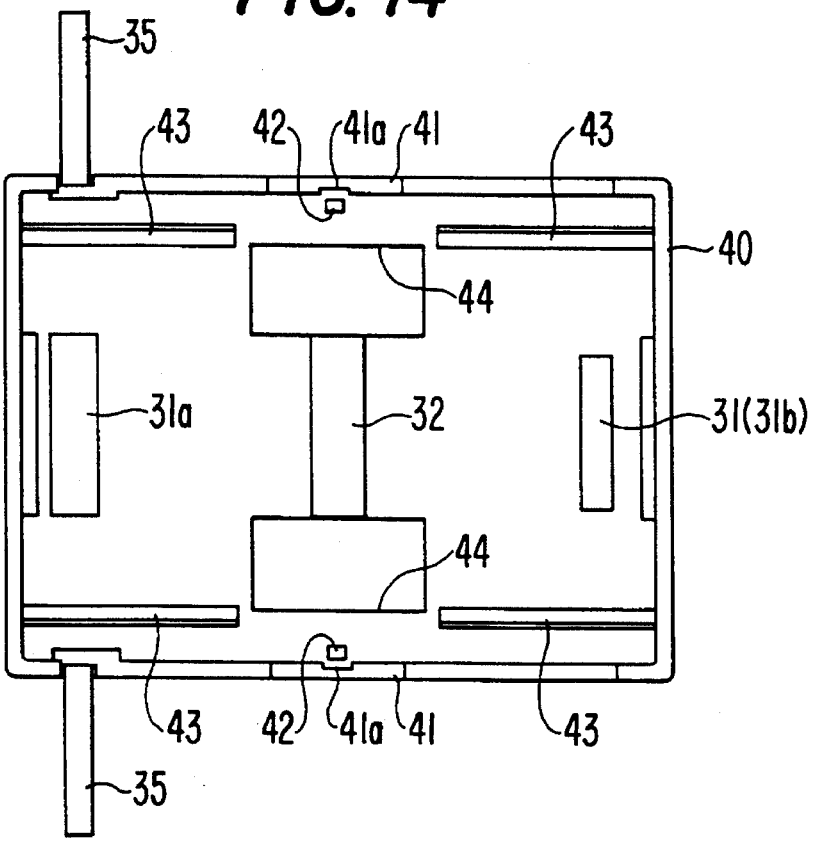
FIG. 14 is a view of the undersurface of the electromagnetic case on the electromagnetic relay of FIG. 1.
Figure 15:
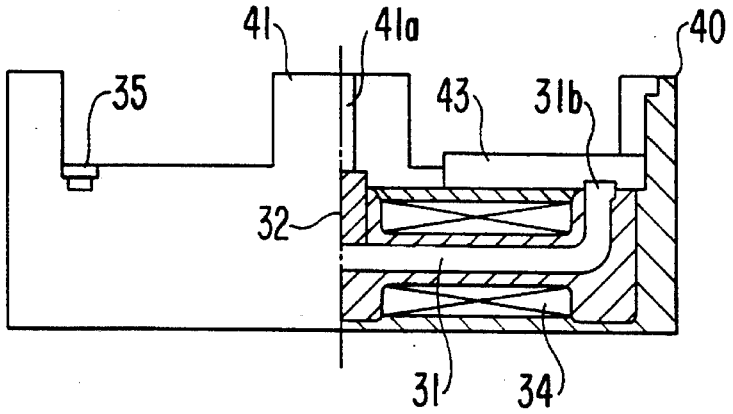
FIG. 15 is a cross-section of the front portion of the electromagnetic case on the electromagnetic relay of FIG. 1.
Figure 16:
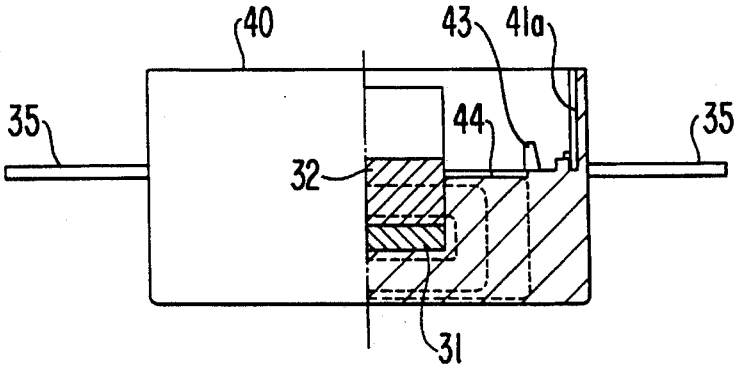
FIG. 16 is a cross-section of the lateral portion of the electromagnetic case on the electromagnetic relay of FIG. 1.

The central support member 13 has an opening 13*a* on one side of its midsection, through which is exposed columnar shaft 11*c*. The columnar shaft 11*c* is the rotational fulcrum of the armature 11. (FIG. 5)

The base sections 21, 22 are molded so that they appear roughly L-shaped in cross section. The front ends of the base sections protrude toward each other to form base 20. Fixed contacts 15*a*, 16*a* are visible on fixed contact terminals 15 and 16, which are molded on the upper surface of benches 23, 24, on the corners of sidewalls 28.

Connecting pieces 14*a*, which are on the base of movable contact terminal 14, are bent to form a rotating shaft. Because the front ends of base sections 21, 22 protrude toward each other to form base 20, movable contacts 12*a*, 12*b* are positioned so that they can contact or draw away from fixed contacts 15*a*, 16*a*, respectively. Fixed contact terminals 15, 16, which protrude outward from sidewalls 28 on base sections 21, 22, are bent downward onto the bottoms of the base sections.

Thus, the relay has a "leadless" design. The bending of the terminals completes base 20, which now includes the mechanism for making and breaking contact.

In this embodiment, movable contactors 12 and other components are formed from a single lead frame. This innovation simplifies management of the production process.

When base sections 21, 22 protrude toward each other, a sealing groove 27 (See FIG. 4) is formed between end portion 26 on base section 22 and end portion 25 on section 21. The sidewalls 28 now face each other.

Electromagnetic case 40 is formed by secondary molding of electromagnetic block 30, as shown in FIGS. 12 through 16.

In the electromagnetic block 30, permanent magnet 32 is positioned in the center of U-shaped iron core 31 and molded to bobbin 33. Coil 34 is wound around the center of the bobbin 33, and the ends of the coil are tied and welded to studs 35*a* on coil terminals 35, which protrude from the side of shelves 33*a* on bobbin 33. End 31*a* of iron core 31 is bent outward. The contacting surface area of end 31*a* of the iron core 31 is larger than that of the opposite end 31*b*.

The electromagnetic block 30 is molded in electromagnetic case 40 so that ends 31*a*, 31*b* of iron core 31 and the end surfaces of permanent magnet 32 are exposed within block 30. The coil 34 is wound around the block.

The sides of the electromagnetic case 40 are cut away except for the central portions 41 of the sidewalls. On each of the opposing faces of the central portions 41 is a guide slot 41*a*, which engages with and guides each of the connecting pieces 14*a*, which are the bent portions of movable contact terminals 14. On the ceiling of the electromagnetic case 40, at the lower end of the guide slots 41*a*, are two teeth 42, which contact with the connecting pieces 14*a* and control their position, and two ribs 43, which engage with the insides of sidewalls 28 on base 20 and prevent the sealant from flowing into the case. Two depressions 44 on the ceiling of case 40 prevent central support member 13 of rotating armature 11 from contacting the ceiling of the case.

When electromagnetic case 40 is fit onto the base 20, connecting pieces 14*a*, which are the bent portions of movable contact terminals 14, engage in and are positioned by guide slots 41*a* on central portions 41 of the sidewalls. Guide teeth 42 press against connecting pieces 14*a* to prevent them from rattling. Columnar shaft 11*c* of movable armature 11 is adhered magnetically to the exposed portion of the surface of permanent magnet 32 and pivotally supported thereby. Ends 11*a*, 11*b* of armature 11 oppose ends 31*a*, 31*b* on iron core 31 so that the ends 11*a*, 11*b* alternately contact with and draw away from the ends 31*a*, 31*b* of the iron core 31.

Coil terminals 35 are bent, and electromagnetic case 40 is fit onto base 20 to form an integral unit. Sealant 50 is poured into the compartments formed by ribs 43 on case 40 and sidewalls 28 on base 20 and into sealing groove 27 on the bottom of base 20. When the sealant hardens (FIG. 4), the assembly process is complete.

It would also be possible to create an electromagnetic case 40 by installing a discrete electromagnetic block 30 in a previously molded case.

We shall next explain the operation of an electromagnetic relay described above.

The contacting surface area of end 31*a* of iron core 31 is larger than that of the opposite end 31*b* of the iron core 31 so that in the absence of an exciting current, the two sides are magnetically unbalanced. Thus, end 11*a* of movable armature 11 is adhered to end 31*a* of iron core 31 by the magnetic force of permanent magnet 32, and movable contacts 12*b* on contactors 12 are held in contact with fixed contacts 16*a*.

When voltage is applied to coil 34 on electromagnetic block 30 to generate magnetic force opposite that of the permanent magnet 32, movable armature 11 rotates in the direction opposite the magnetic force of magnet 32. Movable contacts 12*b* are drawn away from fixed contacts 16*a*, and movable contacts 12*a* are brought into contact with fixed contacts 15*a*. The opposite end 11*b* of armature 11 is adhered to the opposite end 31*b* of iron core 31.

When the exciting current is withdrawn from coil 34, the magnetic force of permanent magnet 32 causes armature 11 to rotate in the opposite direction, and it returns to its previous state.

Figure 17:
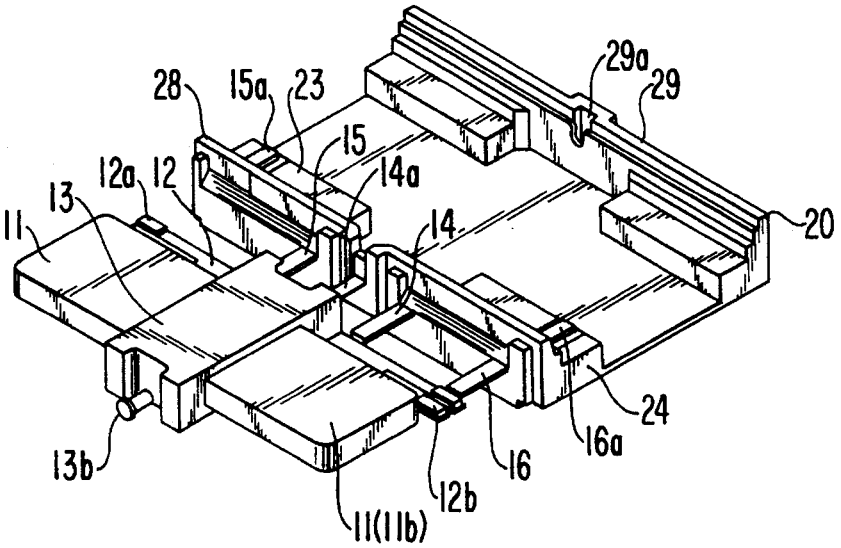
Figure 18:
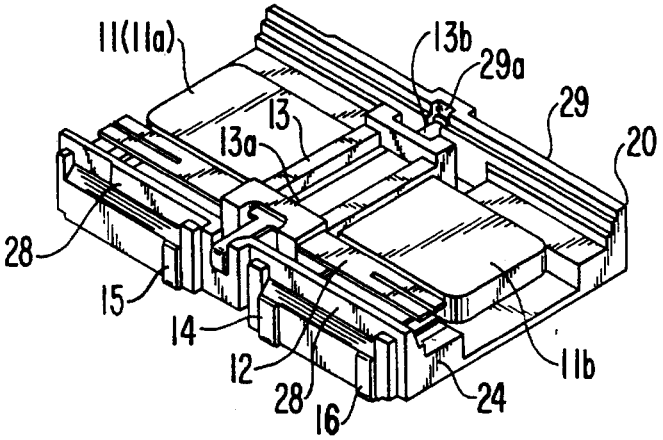
Figure 19:
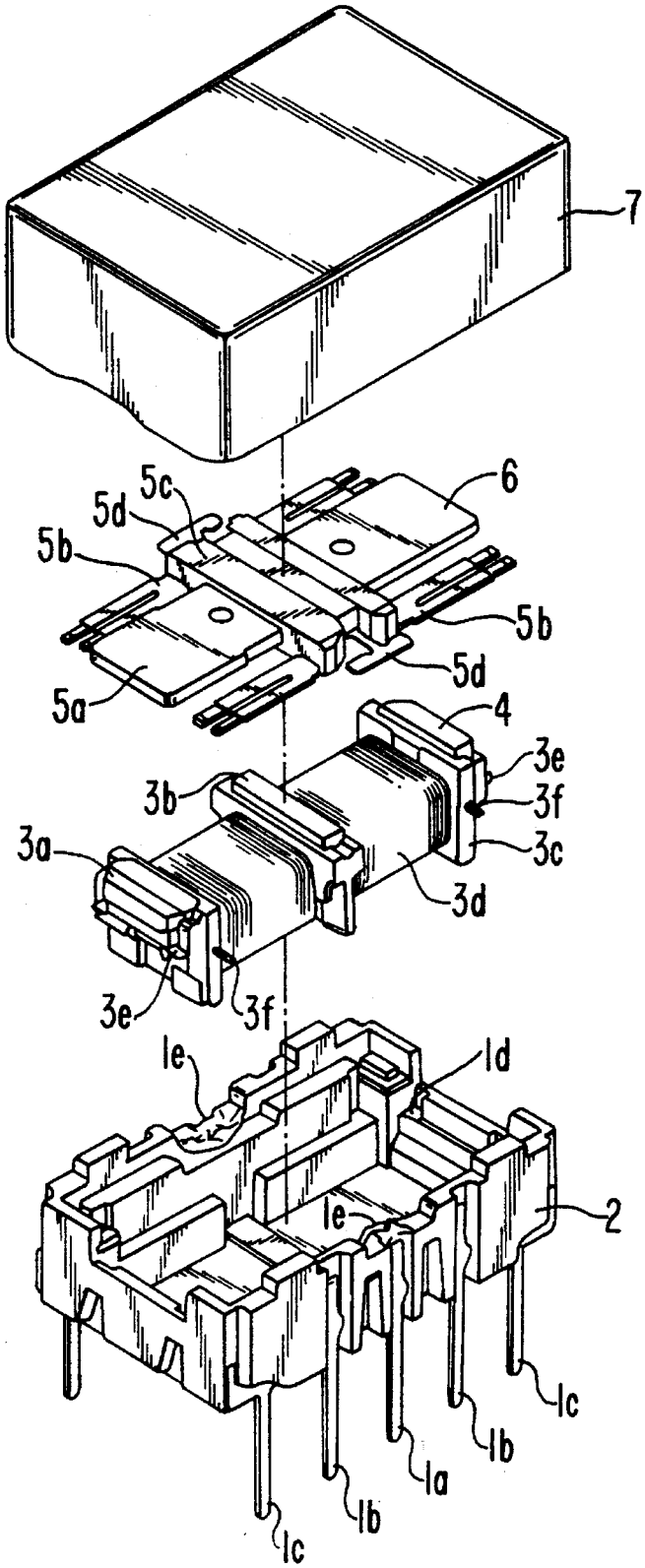
FIG. 19 (PRIOR ART)
FIG. 19 is an exploded oblique view of an existing electromagnetic relay.

A second preferred embodiment of this invention is shown in FIGS. 17 and 18. Similar elements are identified with the same numbers used in the description of other figures.

In the first embodiment, movable contactors 12 are provided on both sides of armature 11. In the second embodiment, there is a movable contactor 12 on only one side of armature 11. A J-shaped movable contact terminal 14, which extends from movable contactor 12, is molded to base 20, which has a U-shaped cross section.

In this second embodiment, connecting piece 14*a*, which is located on the base of the movable contact terminal 14, is bent to form a rotating shaft. Rotating shaft 13*b*, which protrudes from an end of central support member 13, engages into niche 29*a* on sidewall 29 of base 20. Thus, movable contacts 12*a*, 12*b* on contactor 12 can contact with and draw away from fixed contacts 15*a*, 16*a*.

In the second embodiment, base 20 is assembled by bending connecting piece 14*a* on movable contact terminal 14. This greatly simplifies assembly of the relay. The rotating shaft 13*b* engages with base 20 to prevent it from rattling. This design offers the advantage of preventing plastic deformation of connecting piece 14*a*, which serves as the rotating shaft.

In another preferred embodiment, it would also be possible to have movable contactors 12 arrayed on either side of armature 11.

In both of the embodiments discussed above, movable contactors 12 were integrally formed with armature 11. However, the invention is not limited to this design. Movable contactors 12 could be furnished directly on base 20 with only armature 11 pivotally supported. In this case, the movable contactors 12 would be depressed by armature 11 to make and break the contacts.

Although the invention has been described above by way of examples with reference to the accompanying drawings, it is to be noted that various changes and modifications will be apparent to those skilled in the art. Thus, the present invention is not limited to the embodiments described above. Therefore, unless such changes and modifications otherwise depart from the spirit and scope of the present invention, they should be construed as being included therein.

What is claimed is:

1. An electromagnetic relay comprising:

a movable armature having two sides;

an electromagnetic block; and a base comprised of a support member, a plurality of movable contactors having movable contacts disposed thereon, said movable contactors disposed lengthwise on each of said two sides of said movable armature, said movable armature and said movable contactors formed integrally with said support member, a plurality of movable contact terminals having connecting pieces disposed thereon, said connecting pieces extending from said movable contactors and being bent to form a rotating shaft for supporting said movable armature, a plurality of fixed contact terminals having fixed contacts disposed thereon, wherein contacts between said movable contacts and said fixed contacts are made and broken by the movement of said movable armature in accordance with the magnetization and demagnetization of said electromagnetic block.

2. An electromagnetic relay according to claim 1, wherein said support member is molded.

3. An electromagnetic relay according to claim 1, said electromagnetic relay further comprising a case which fits on said base, wherein the end of said rotating shaft which protrudes from said movable armature is pivotally supported by said case.

4. An electromagnetic relay according to claim 1, wherein the end of said rotating shaft which protrudes from said movable armature engages with said base and is pivotally supported.

5. An electromagnetic relay according to claim 1, wherein said movable contact terminals are molded to said base.

6. An electromagnetic relay according to claim 1, wherein said base is comprised of a plurality of base sections having an L-shaped cross-section, each of said base sections have a front end portion, said plurality of fixed contact terminals comprise a pair of contact terminals, and are molded onto each of said movable contact terminals, and said front end portion of each of said base sections protrude toward each other to form said base.

7. An electromagnetic relay according to claim 6, wherein said plurality of base sections comprise two base sections.

8. An electromagnetic relay comprising:

a movable armature having two sides;

an electromagnetic block;

a base comprised of a support member, a plurality of movable contactors having movable contacts disposed thereon, said movable contactors disposed lengthwise on each of said two sides of said movable armature, said movable armature and said movable contractors formed integrally with said support member, a plurality of movable contact terminals, at least one of said movable contact terminals has a connecting piece which extends from said movable contactors, said connecting piece being bent to form a rotating shaft for supporting said movable armature, and a plurality of fixed contact terminals having fixed contacts disposed thereon, wherein contacts between said movable contacts and said fixed contacts are made and broken by the movement of said movable armature in accordance with the magnetization and demagnetization of said electromagnetic block.

9. An electromagnetic relay according to claim 8, wherein said support member is molded.

10. An electromagnetic relay comprising:

a movable armature having two sides;

an electromagnetic block; and a base is comprised of a plurality of movable contacts, a plurality of fixed contacts, and at least one connecting piece having first and second ends, said connecting piece being bent to form a rotating shaft for supporting said movable armature, said first end of said connecting piece being disposed on at least one of said two sides of said movable armature, said second end of said connecting piece being formed integrally with said base, wherein contacts between said movable contacts and said fixed contacts are made and broken by the movement of said movable armature in accordance with the magnetization and demagnetization of said electromagnetic block.

11. A method of making an electromagnetic relay comprising the steps of:

molding a plurality of connecting pieces on said base;

positioning one end of one of said connecting pieces on at least one side of a movable armature;

forming a rotating shaft by bending said connecting piece so that said rotating shaft pivotally supports said movable armature on a base;

integrally forming the other end of a connecting piece with said base;

molding a support member on said base;

positioning said movable contactors lengthwise along either side of said movable armature so that said movable armature and said movable contactors are integrally formed said support member;

molding a plurality of base sections, which are roughly L-shaped when viewed in cross section, onto each of said movable contact terminals;

disposing the front ends of each of said base sections toward each other to form said base; and pivotally supporting the other end of said rotating shaft, which protrudes from the other side of said movable armature, by a case which fits onto said base.

12. A method of making an electromagnetic relay comprising the steps of:

molding a support member;

positioning said movable contactor lengthwise along one side of a movable armature;

integrally forming said movable armature and said movable contactor with said support member;

providing movable contact terminals, which are connecting pieces, on said movable contactor;

molding said movable contact terminals to a base;

bending one of said connecting pieces on said base of said movable contact terminal to form a rotating shaft; and pivotally supporting the other end of said rotating shaft, which protrudes from the other side of said movable armature, by said base.

* * * * *